US007607645B2

(12) United States Patent
Smith

(10) Patent No.: US 7,607,645 B2
(45) Date of Patent: Oct. 27, 2009

(54) INTERLOCKING HIGHWAY STRUCTURE

(75) Inventor: Rodney Smith, Midland, VA (US)

(73) Assignee: Easi-Set Industries, Midland, VA (US)

( * ) Notice: Subject to any disclaimer, the term of this patent is extended or adjusted under 35 U.S.C. 154(b) by 0 days.

(21) Appl. No.: 12/133,603

(22) Filed: Jun. 5, 2008

(65) Prior Publication Data

US 2008/0303010 A1 Dec. 11, 2008

(51) Int. Cl.
*E01F 15/02* (2006.01)

(52) U.S. Cl. ..... 256/13.1; 404/6

(58) Field of Classification Search ..... 256/13.1; 404/6, 7, 9, 13
See application file for complete search history.

(56) References Cited

U.S. PATENT DOCUMENTS 2,085,058 A * 6/1937 Wood ..... 256/13.1
3,082,994 A * 3/1963 Rasmussen ..... 256/13.1
3,980,279 A * 9/1976 Bofinger ..... 256/13.1
4,605,336 A * 8/1986 Slaw, Sr. ..... 404/6
4,806,044 A * 2/1989 Duckett ..... 404/6
4,828,425 A * 5/1989 Duckett ..... 404/6
5,046,884 A * 9/1991 Girotti ..... 404/6
5,149,224 A * 9/1992 Smith ..... 404/6
5,286,136 A * 2/1994 Mandish et al. ..... 404/6
5,464,306 A * 11/1995 Cristiano ..... 404/6
5,975,793 A * 11/1999 Simmons et al. ..... 404/6
6,679,649 B1 * 1/2004 Capolupo ..... 404/6
6,840,706 B1 * 1/2005 Camomilla et al. ..... 404/6
6,848,857 B1 * 2/2005 McColl et al. ..... 404/6
7,144,187 B1 * 12/2006 Nolte et al. ..... 404/6
7,165,916 B2 * 1/2007 Nanayakkara ..... 405/285
7,226,236 B2 * 6/2007 Mertens ..... 404/6

* cited by examiner

*Primary Examiner*—Daniel P Stodola
*Assistant Examiner*—Joshua T Kennedy
(74) *Attorney, Agent, or Firm*—Whitham Curtis Christofferson & Cook, PC

(57) ABSTRACT

A highway crash barrier structure with an improved interlocking system includes a plurality of rigid sections disposed end-to-end in interlocking relationship with one another. The ends of each rigid upright section are provided with a reshaped JJ Hooks® connection. Each hook member has an extending vertical lip which is bent into a "J" shaped cross-section to engage a similar lip on the hook member of the adjacent section such that lateral movement of the respective sections is prevented. However, the respective sections of the system can be easily placed or removed by vertically displacing them. In addition, the interlocking plates at each end of the upright sections are vertically lengthened while the number of bars welded to the plate is increased to reduce the rotational moment of the sections and increase shear transfer between adjacent sections. Furthermore, connections include deflection limitation stops located at the lower part of each end of each upright section which prevents spalling and decreases deflection during a crash. The deflection stops can be positioned wholly within the rigid sections or can protrude partway out the bottom of the sections for particular applications.

15 Claims, 3 Drawing Sheets

INTERLOCKING HIGHWAY STRUCTURE

FIELD OF THE INVENTION

The invention generally relates to a highway crash barrier system able to address current requirements for improving the crash performance of precast concrete barriers. The barrier system comprises a plurality of rigid sections disposed end-to-end in interlocking relationship with one another. The end of each section has a cavity and is provided with embedded interlocks that join with one another to hold the sections together. Individual sections can be removed or replaced without disrupting the remainder of the barrier system while maintaining proper alignment. The invention has application both in road and in highway environments, as well as being used for protection and security at airports, government buildings, and the like.

BACKGROUND OF THE INVENTION

In recent years, for controlling the flow of traffic, various barrier systems consisting of large sections of precast concrete have been used along highways. The sections can be hoisted into place and removed with greater speed and ease than is usually required to construct more permanent structures. Systems of this type can be dislodged when sufficient external force is applied, resulting in a potential traffic hazard. In some instances, the concrete sections are bolted together to maintain their alignment and assure that they will not be either knocked over or displaced by a colliding vehicle. However, such systems have the disadvantage of being complex and expensive and require considerable time and effort to assemble as well as to remove without disassembling the entire structure when used in road repairs.

Improvements in the system of bolted connections has been the use of looped steel bars that allow for a straight steel pin connection holding the adjoining loops together. This system is expensive and relies on maintaining the pins which also requires one's hands in a dangerous position between the barrier sections during placement or replacement. Vehicle impact on these systems usually requires significant time and expense to remove the pins.

U.S. Pat. No. 5,149,224 to Smith, which is herein incorporated by reference, shows an interlocking highway structure which employs a pair of "J" shaped hooks that connect separate concrete barrier members together without requiring extra hardware. In practice, the end of one precast concrete member is simply slid downward from the top such that the two adjoining precast concrete members have interlocking J connections. The product is commercially marketed as "JJ Hooks®". The JJ Hooks product includes a short, approximately 10 inches in length, member to which rebar members are welded and extend inward into the precast concrete. While FIG. 3 of U.S. Pat. No. 5,149,224 shows the rebar extending only part way into the precast concrete, in practice the rebar can extend end-to-end with weldment of the rebar to both attachment hooks or can extend only part way into the precast concrete based on steel shear analysis.

Modifications to the JJ Hooks® design would be beneficial in order to address newer crash test criteria and to allow for greater use of the concrete barriers.

SUMMARY OF THE INVENTION

It is an object of the present invention to provide an inexpensive highway crash barrier system consisting of rigid sections which are joinable together, which are easily separated from each other, and which provide improved crash performance.

A further object of the present invention is to provide an improved system of interlocking sections for a highway crash barrier system in which the sections engage one another in a simple but mechanically sound manner to facilitate alignment and stability of the entire system without encumbering it with expensive and complex coupling devices. The present invention includes longer sections of connecting plate area than prior designs of JJ Hooks® which reduces the rotational moment of the barrier system segments in both the free-standing and the bolted down configurations, and integral deflection limiting "stops" which provide improvement in barrier deflection during impact.

According to the invention, an interlocking barrier system includes a plurality of rigid upright sections that can be joined together end-to-end using a "J" shaped connection member. The connection member preferably is embedded in a recessed cavity in each end of each section and has an outwardly projected hook. The connection member, as well as its associated hook and an outwardly projected receptacle flange, ran linearly along a line extending from the top to the bottom of each end of each section (e.g., 24") a distance which almost equals the height of each section. A plurality of bars (e.g. rebar) are welded or otherwise joined to the connection member and extend into the concrete section a distance that assures steel shear at pullout. In one embodiment, the rebar may extend end-to-end in the barrier structure. In another embodiment, the rebar do not traverse end-to-end distance of the section, and may extend two feet or more. This configuration eliminates or reduces the rotational forces imparted by a collision at one end of the section being imparted at the other end, thus making the interlocking structure more compliant with newer crash test safety requirements.

Further, the addition of deflection limitation stops positioned at the forward lower corners of each section prevents spalling and damage at the corners and limits the deflection of each section from crash impact. The reduction in spalling of the leading edge of the barrier segments at the base significantly reduces deflection of the chain of barrier segments upon vehicle impact which increases the safety margin for workers behind the precast barriers.

The combination of the longer connection length and deflection limitation blocks enhances the stiffness of the system when free-standing, bolted, or pinned down, resulting in a significant reduction in the rotational moment providing less ride down acceleration and vaulting for the impacted vehicle and its occupants.

BRIEF DESCRIPTION OF THE DRAWINGS

The advantages of the present invention will be more fully understood by having reference to the annexed drawings.

DETAILED DESCRIPTION OF THE INVENTION

Figure 1:
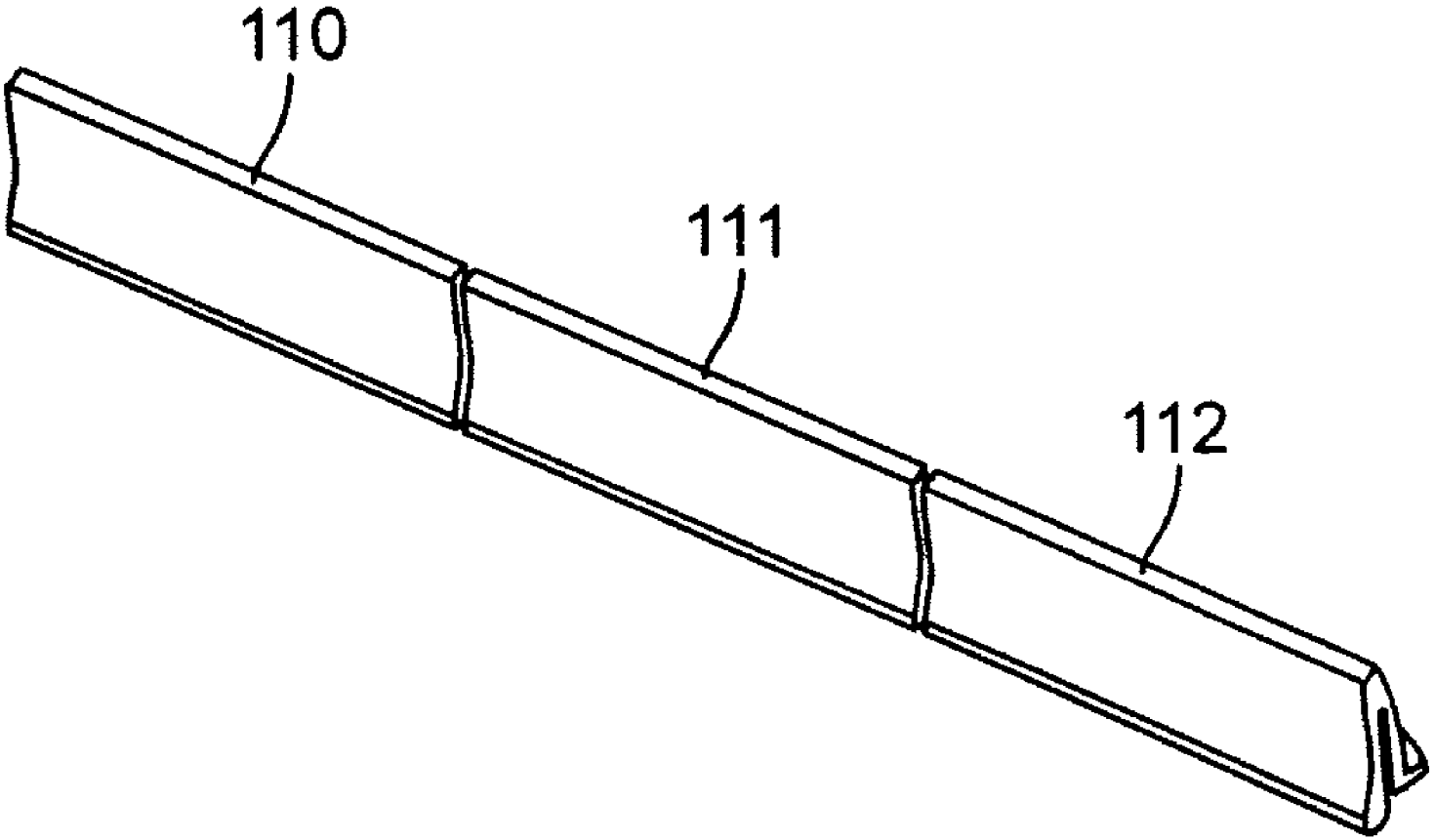
FIG. 1 shows the alignment of three interlocked barrier sections.

In FIG. 1 of the drawings, for exemplary purposes, three rigid upright sections 110, 111, and 112 linked end-to-end in alignment to form a highway barrier system. An unlimited number of sections can be linked together and positioned to follow the path of a roadway (or perimeter of a building in the case of building protection application) in the practice of the invention. Further, the outer shape and length of the upright sections 110, 111, and 112 can vary for different applications. The invention can be used in roadwork as well as security and other applications.

Figure 2:
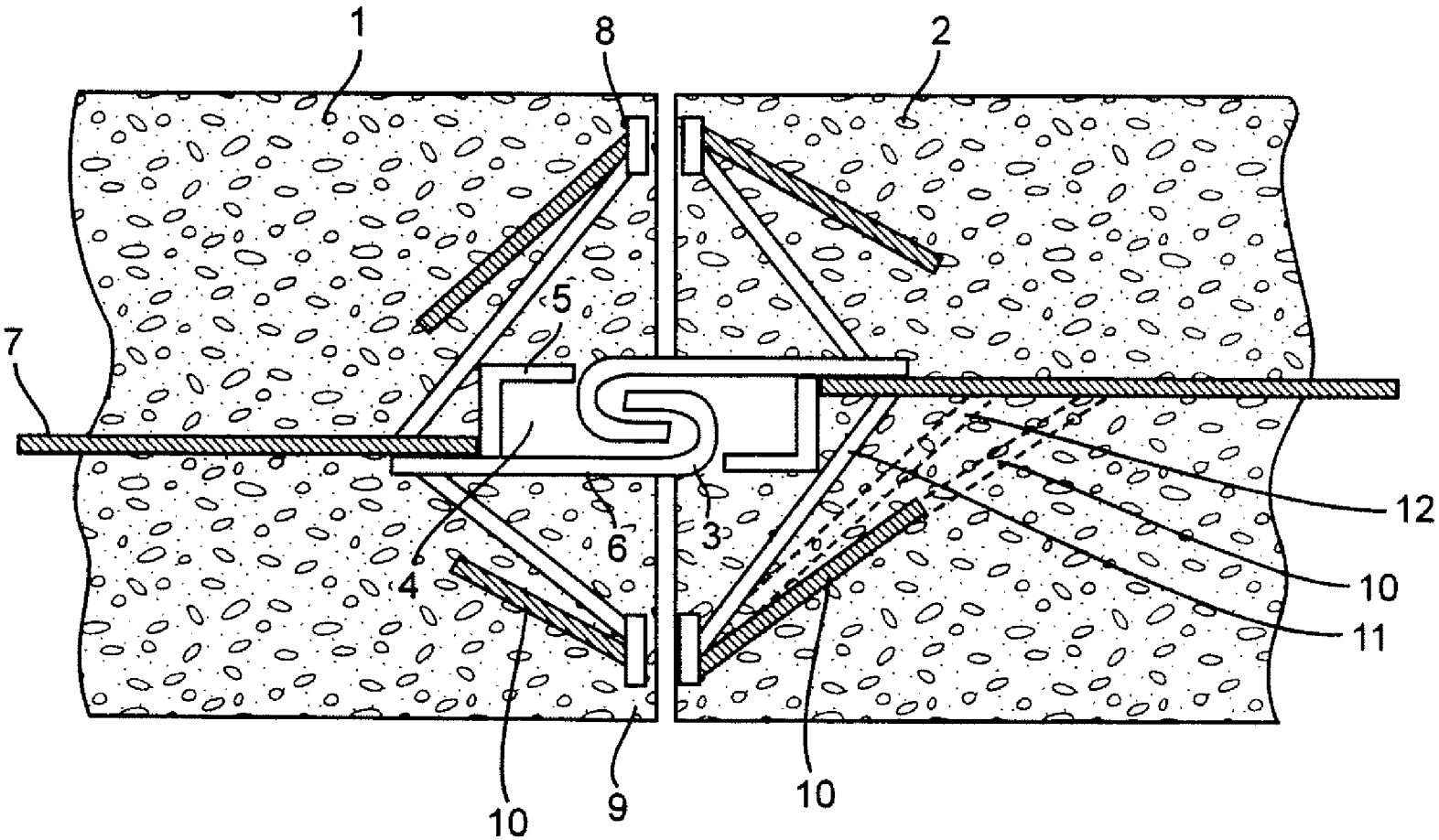
FIG. 2 is a top plan view in partial cross-section of the interface of two barrier sections illustrating the interlock system.

FIG. 2 of the drawings illustrates in detail the actual interlocking structure whereby two rigid upright sections 1 and 2 of the barrier system are maintained in alignment with one another. As illustrated, the hook member 3 in the cavity 4 of the end of each upright section projects outward from the section. A recessed flanged member 5 is attached to the connection member. Metallic welded bars 7 (only one bar is visible on this top plan view) extend, preferably in a parallel linear direction into the concrete of each upright section but do not necessarily extend from end to end of each section. Preferably, the bars 7 extend no more than 30 times their diameter into the precast concrete, thus providing required shear strength to the bars 7, but the bars 7 could extend end-to-end for the upright sections 1 and 2 and be welded to the connecting member at each end. By extending only a limited distance, the complete J shaped connection can be galvanized if desired. Completing the system is a pair of deflection limitation stops 8 which may be connected to the connection member 6 by using a bar 11 and may be connected to at least one bar 7 using bar 12 that extends from the connection member 6 or by using a bar 10 welded to the rear side of limitation stop 8 and which may extend to a bar 7. FIG. 2 shows bars 11 on each side of the connection members 6 and shows a bar 12 in as a dashed outline and shows a dashed outline extending from a bar 10; however, it should be understood that there could be four bars 12 and for extended bars 10 in a similar configuration as shown for bars 11. For placement in the form and to keep the relative position and spacing bars 10, 11 or 12 are secured to the connection member 6 or a bar 7 when casing the rigid upright sections 1 and 2. The deflection limit stops 8 will most likely be embedded in the concrete at an angle and be positioned at a depth to provide resistance to movement/crushing of stop 8 thereby preserving the "integrity" of the barrier "toe". The deflection stops 8 are disposed at the lower part 9 of each end of each rigid upright section for reinforcement, and also to prevent spalling at the corners.

The deflection limitation stops 8 can be modified to accommodate possible snow plow blade snagging and possible embedment of the lower 2" of the sections into the pavement for permanent. The arrangement and shape of the deflection stops 8 would be determined by those skilled in the art of precast barrier production and application. In the practice of the invention, the configuration and shape of the deflection limitation stops 8 may be adjusted to work with the site installation and roadway applications through the broadening of the contact surfaces of the deflection blocks and moving the position to accommodate road conditions such as snow plow blades.

Figure 3:
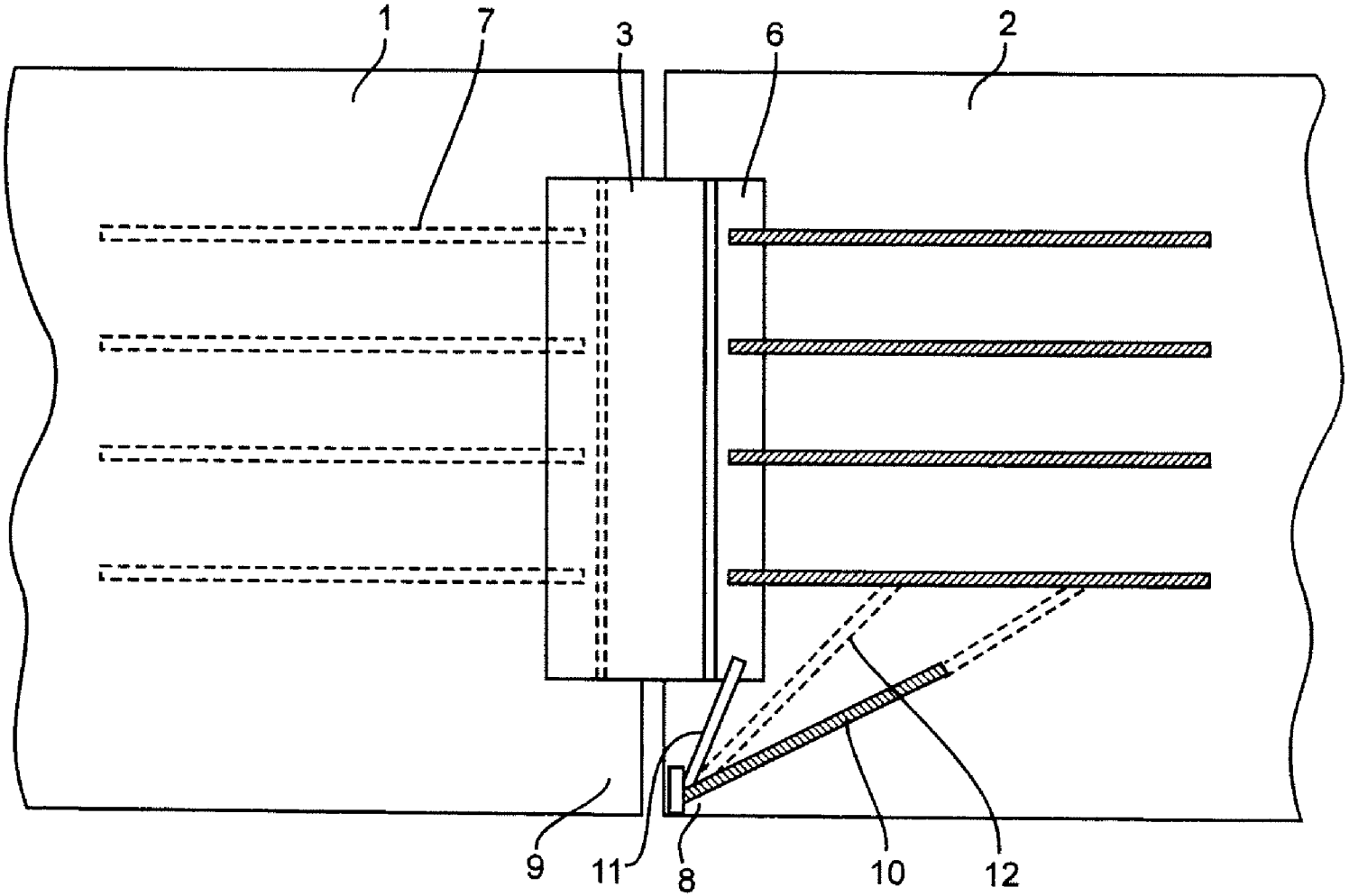
FIG. 3 is a side cutaway view of the interface of two barrier sections with the interlock system.

FIG. 3 of the drawings is a side cutaway view of two adjacent upright sections, and illustrates the interlocked hooks 3 embedded within the respective barrier upright sections 1 and 2. The hooks 3 extend linearly a given length along a line running from the top to the bottom of each rigid upright section (preferably approximately two feet for highway barriers). As shown, four bars 7 are welded to the connection member 6 of each end of each upright section and run parallel to each other extending a given length of approximately two feet from the hook member to the other end of each upright section (or they can run the entire length of the upright sections 1 and 2. It should be understood that the number of bars 7 can vary (e.g., two, three, four, five, etc.) depending on the requirements for the precast concrete. In addition, it can be seen in FIG. 3 the pair of deflection limitation stops 8 are connected to connection member 6 by means of bar 11, or bar 12, or may be connected to at least one bar 7 using an extended bar 10 welded to its rear side. As discussed above, the deflection limit stops 8 will most likely be embedded in the concrete at an angle and be positioned at a depth to provide resistance to movement/crushing of stop 8 thereby preserving the "integrity" of the barrier "toe". The deflection limitation blocks are located at the lower part 9 of each end of each upright section.

While the invention has been described in terms of its preferred embodiments, those of skill in the art will recognize that the invention can be practiced with modification within the spirit and scope of the appended claims.

What is claimed is:

1. An interlocking barrier system, comprising:

a plurality of rigid upright sections which are linkable end-to-end in an interlocking fashion;

a connection member embedded in each of a first and a second end of each rigid upright section, each said connection member having a hook member which projects outward from said first or said second end of each rigid upright section wherein said hook member extends linearly a given length along a line running from a top to a bottom of each rigid upright section, wherein said given length along said line running from said top to said bottom of each rigid upright section is greater than 20 inches, a flange member which is recessed in said first or said second end of each upright section wherein said flange member extends linearly said given length along said line running from said top to said bottom of said rigid upright section, and wherein said flange member is positioned behind said hook member in a front to back dimension and includes a portion which projects towards said hook member, and a plurality of bars which extend linearly a given length along a line running from said first end to a second end of each rigid upright section, said given length being equal to or less than a length extending from said first end to said second end at least a pair of deflection limitation stops in the form of plates each having a front side and a back side embedded in each of said first and second ends of each of said rigid upright sections on opposite sides of said connection member at the lower part of each end of each rigid uptight section at a position where the front sides of the plates will face front sides of another pair of deflection stops embedded in an end of an adjacent rigid uptight section of said plurality of rigid upright sections, and where a bar is secured to said back side each of said plates in said pair of deflection limitation stops and extends at an acute angle towards the connection member, whereby said pair of deflection limitation stops provides reinforcement of lower comers of said rigid upright section and prevent spalling.

2. The interlocking barrier system of claim 1 wherein each of said pair of deflection limitation stops are connected to said connection member.

3. The interlocking barrier system of claim 1 wherein each of said plurality of bars which extend linearly said given length that is less than a length extending from said first end to said second end.

4. The interlocking barrier system of claim 1 wherein said hook member and said flange member of said connection member extend linearly more than ⅔ the distance along said line running from said top to said bottom of each rigid upright section.

5. The interlocking barrier system of claim 1 wherein said plurality of bars are parallel to one another.

6. The interlocking barrier system of claim 1 wherein each of said plurality of bars are welded to said hook member of said connection member.

7. The interlocking barrier system of claim 1 wherein the configuration and shape of the deflection limitation stops is adjustable to work with the site installation and roadway applications through broadening of contact surfaces of the deflection blocks and moving the position to accommodate road conditions such as snow plow blades.

8. The interlocking barrier system of claim 1 wherein the connection member, hook member, flange member and plurality of bars are galvanized.

9. An interlocking barrier system, comprising:

a plurality of rigid upright sections which are linkable end-to-end in an interlocking fashion;

a connection member embedded in each of a first and a second end of each rigid upright section, each said connection member having a hook member which projects outward from said first or said second end of each rigid upright section wherein said hook member extends linearly a given length along a line running from a top to a bottom of each rigid upright section, a plurality of bars which extend linearly a given length along a line running from said first end to a second end of each rigid upright section, said given length being less than a length extending from said first end to said second end; and a pair of deflection limitation stops in the form of plates each having a front side and a back side embedded in each of said first and second ends of each of said rigid upright sections on opposite sides of said connection member at the lower part of each end of each rigid upright section at a position where the front sides of the plates will face front sides of another pair of deflection stops embedded in an end of an adjacent rigid upright section of said plurality of rigid upright sections, and where a bar is secured to said back side of each of said plates in said pair of deflection limitation stops and extends at an acute angle towards the connection member, whereby said pair of deflection stops provides reinforcement of lower corners of said rigid upright section and prevent spalling.

10. The interlocking barrier system of claim 9 wherein each of said pair of deflection limitation stops is connected to said connection member.

11. The interlocking barrier system of claim 10 wherein a connection between said deflection limitation stops and said connection member is by a bar extending from each of said pair of deflection limitation stops to at least one of said plurality of bars which extend linearly.

12. The interlocking barrier system of claim 10 wherein a connection between said deflection limitation stops and said connection member is by a bar extending from each of said pair of deflection limitation stops directly to said connection member.

13. The interlocking barrier system of claim 9 wherein each of said pair of deflection limitation stops is positioned more towards said bottom than said top of each rigid upright section.

14. The interlocking barrier system of claim 9 wherein said given length along said line running from said top to said bottom of each rigid upright section is greater than 20 inches.

15. The interlocking barrier system of claim 9 wherein said given length along said line running from said top to said bottom of each rigid upright section is greater than half a distance from said top to said bottom of each rigid upright section.

* * * * *